US005487435A

United States Patent [19]

Crawley et al.

[11] Patent Number: 5,487,435

[45] Date of Patent: Jan. 30, 1996

[54] MOUNTING SYSTEM FOR RAISE AND SHAFT CUTTERS

[75] Inventors: Dolph R. Crawley, Arlington; Steven R. Brooke, Mansfield, both of Tex.

[73] Assignee: Baker Hughes Incorporated, Houston, Tex.

[21] Appl. No.: 271,710

[22] Filed: Jul. 7, 1994

[51] Int. Cl.[6] ..... F21B 10/12

[52] U.S. Cl. ..... 175/363; 175/364

[58] Field of Search ..... 175/361, 363, 175/364, 53; 299/86, 93

[56] References Cited

U.S. PATENT DOCUMENTS

| | | | |
|---|---|---|---|
| 3,749,188 | 7/1973 | Schumacher, Jr. | 175/364 |
| 3,851,718 | 12/1974 | Fink | 175/363 |
| 3,863,994 | 2/1975 | Fink | 175/364 |
| 4,004,644 | 1/1977 | Liljekvist et al. | 175/364 |
| 4,129,392 | 12/1978 | Lupton | 403/25 |
| 4,202,418 | 5/1980 | Waddell | 175/361 |
| 4,448,271 | 5/1984 | Persson | 175/364 |
| 4,454,923 | 6/1984 | Tibussek | 175/363 |
| 4,832,135 | 5/1989 | Walk et al. | 175/53 |

*Primary Examiner*—David J. Bagnell

*Attorney, Agent, or Firm*—Robert A. Felsman; Mark D. Perdue

[57] ABSTRACT

A bit body with a mount having a leg that extends along the rotational axis of the bit, a journal with a wedge shaped end secured to a wedge shape opening in the leg. A wedge on the journal has a fastener hole to register coaxially with a fastener hole in the leg and receives a fastener to secure the wedge on the journal in the wedge shape in the leg. One side of the wedge shape is generally perpendicular to the bit axis, and the adjacent side of the wedge forms an acute angle with said perpendicular side. The acute angle is in a range of about thirty to sixty degrees, ideally about 35 degrees.

9 Claims, 4 Drawing Sheets

MOUNTING SYSTEM FOR RAISE AND SHAFT CUTTERS

BACKGROUND OF THE INVENTION

1. Field of the Invention

This invention relates in general to earth boring and in particular to the way in which rotatable cutters are removably secured to raise or shaft drills used in the mining industry.

2. Background Information

The rotatable cutters of raise or shaft drill bits wear during drilling and are replaced periodically with new cutters on the original mounts of the bit body. Because of the large and destructive forces generated during earth drilling, it has been difficult to provide a mounting system that is not only rugged and reliable but also easy to manipulate quickly and easily by those who are responsible for replacing exhausted cutters. There have been a variety of proposed solution—some of significant commercial success—but the need for improvement subsists.

SUMMARY OF THE INVENTION

It is the general object of the invention to provide an improved mounting system to secure raise or shaft cutters to a bit body:

This object is achieved with a bit body that includes a mount having at least one leg that extends at an acute angle to the rotational axis of the bit, a journal having at least one wedge shape end adapted to be secured to a wedge shape opening in the leg, an earth disintegrating cutter rotatably secured to the journal, the wedge on the journal having a fastener hole to register coaxially with a fastener hole in the leg and being adapted to receive a fastener to secure the wedge on the journal in the wedge shape in the leg. One side of the wedge shape is generally perpendicular to the bit axis and the adjacent side of the wedge forms an acute angle with said perpendicular side. The acute angle is in a range of about thirty to sixty degrees, preferably about 35 degrees.

The above as well as additional objects, features and advantages of the invention will become apparent in the following description.

DESCRIPTION OF THE PREFERRED EMBODIMENT

Figure 1:
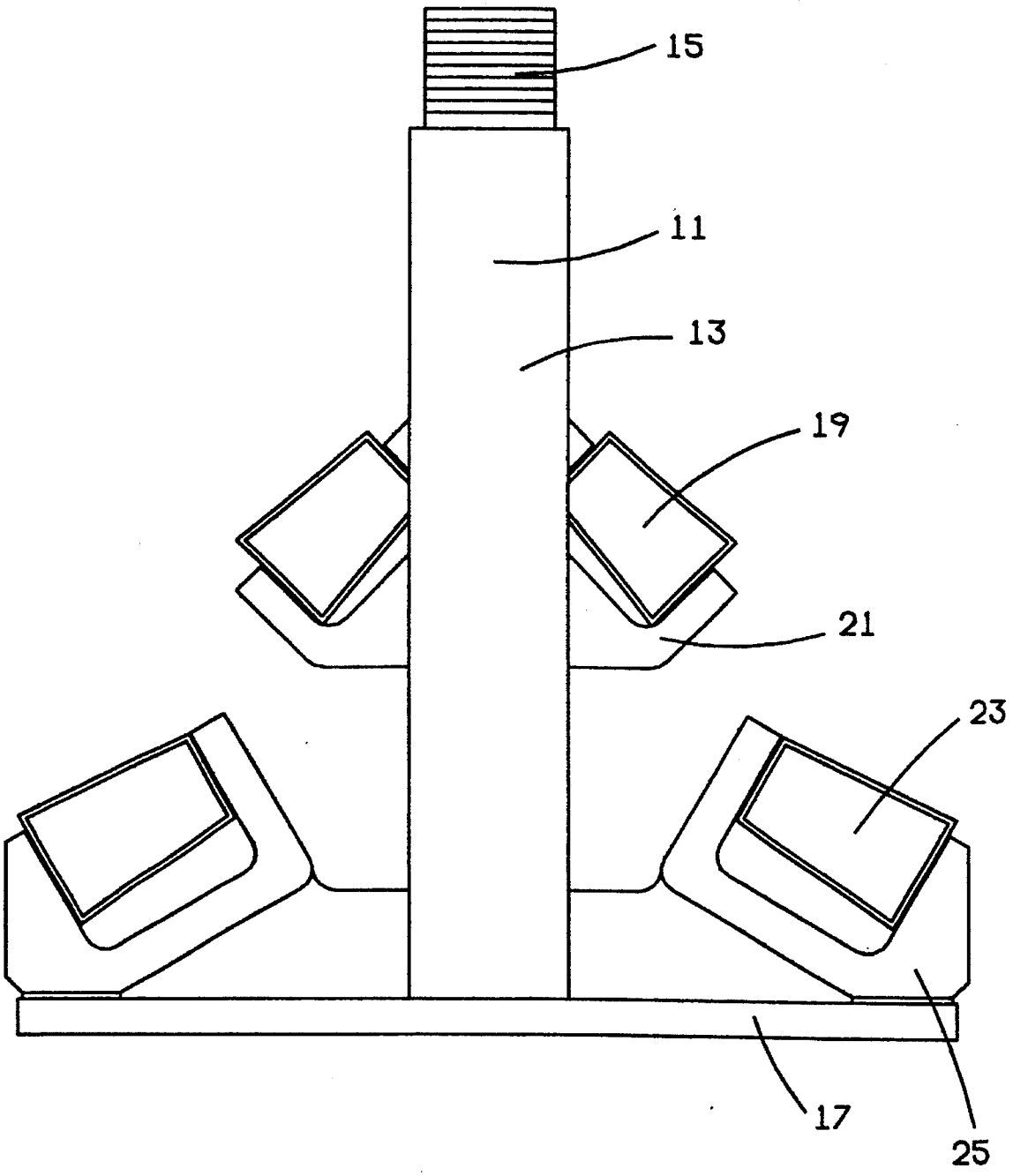
FIG. 1 is a typical raise boring bit assembly.

Referring to the drawings, the numeral 11 in FIG. 1 of the drawing designates a raise boring bit having a central shaft 13, threaded at 15 for attachment to drill pipe (not shown) to rotate as well as raise and lower the bit. The central shaft 13 is attached to a bit body 17. A row of inner cutters 19 is secured by mounts 21 to the central shaft 13, and a row of outer cutters 23 is secured to the saddle by the saddle mounts 25 to the plate 17.

Figure 2:
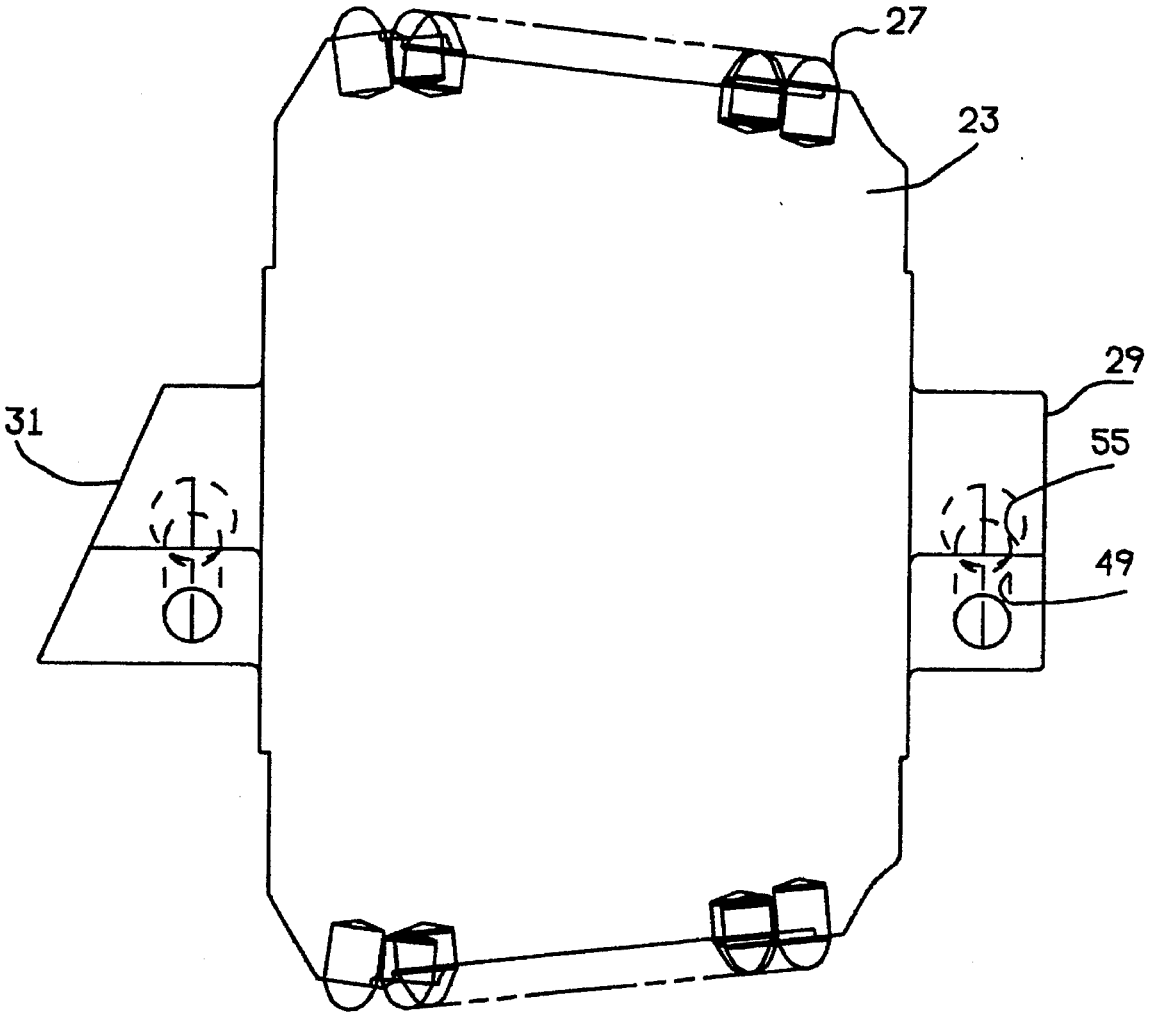
FIG. 2 is a side elevational view of a raise boring cutter with earth disintegrating teeth, the cutter being rotatably mounted on a journal with wedge shaped, protruding ends.

One of the rotatable cutters 23 of the outer row is shown in FIG. 2 separate from the bit body assembly of FIG. 1. The cutter 23 is of the conventional truncated conical configuration and contains a plurality of teeth 27 that here are wear resistant inserts, typically of cemented tungsten carbide, spread about the periphery of the cutter to engage the earth during raise boring in an efficiently destructive pattern. The pattern of the teeth 27 is shown only schematically and intermittently in the drawings since the pattern and shape of the teeth is not the improvement to which the invention is directed.

Figure 3:
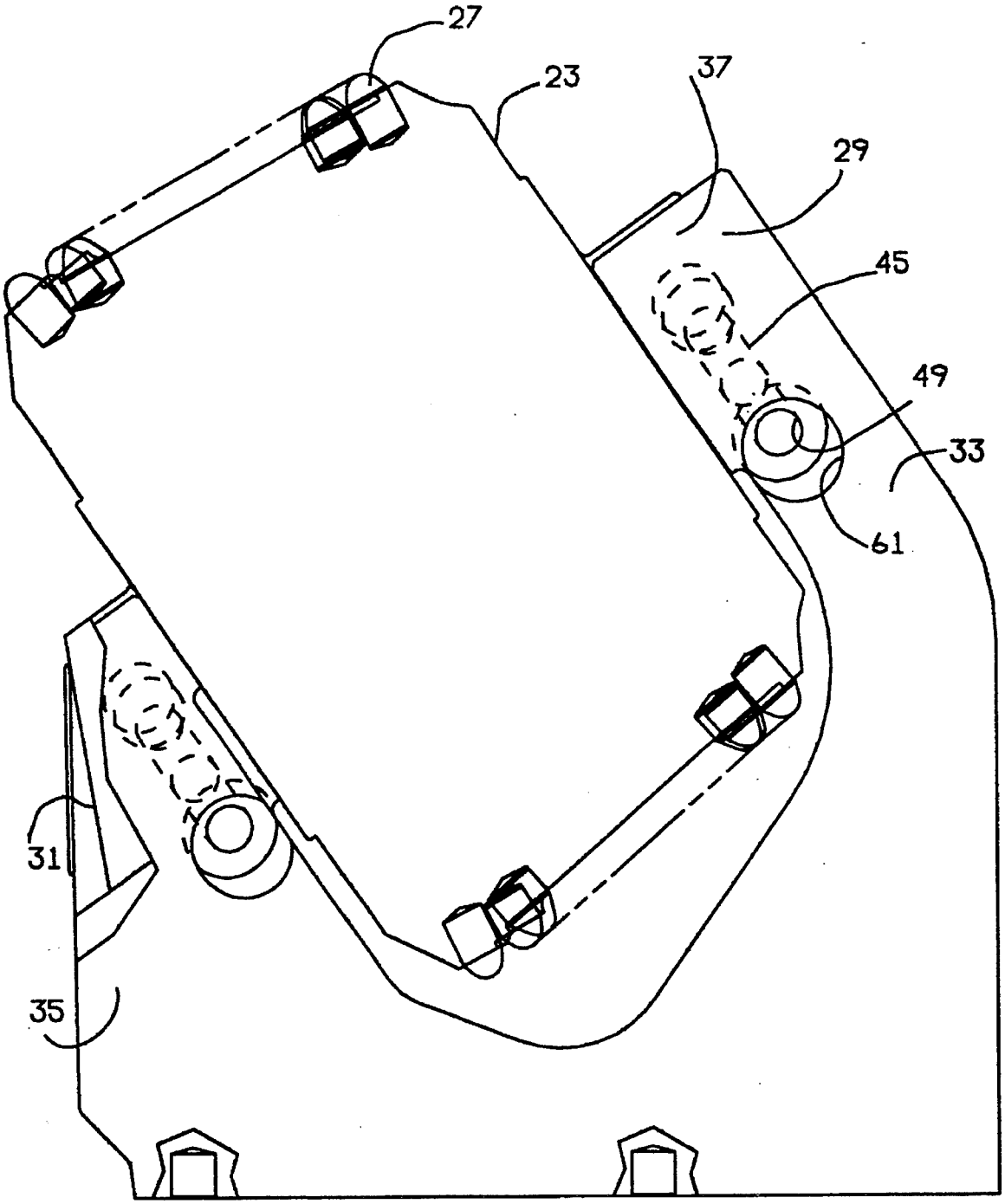
FIG. 3 is a side elevational view of the raise boring cutter of FIG. 2 on a mount, usually called a "saddle" mount that is attached to a bit body.
Figure 4:
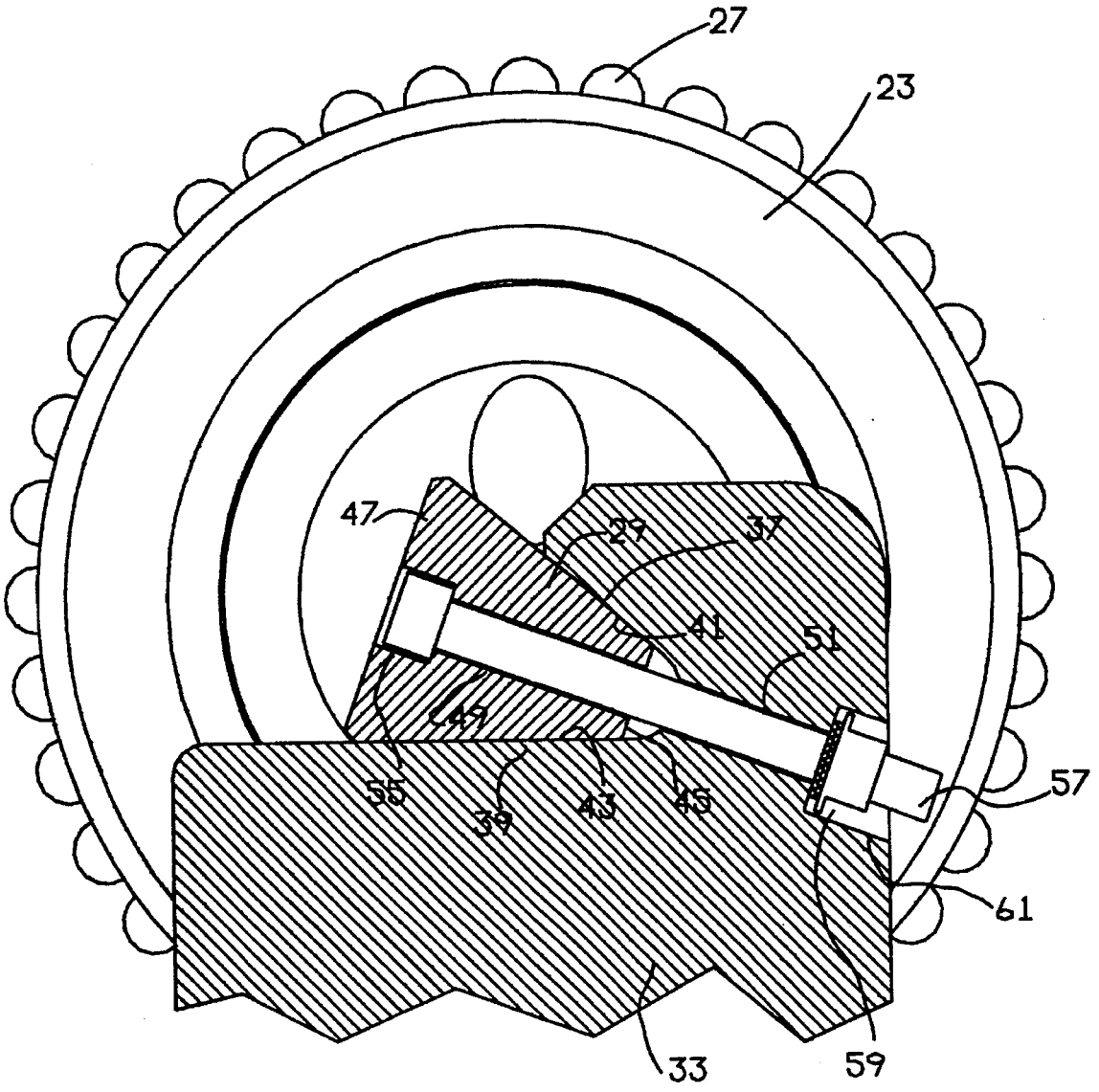
FIG. 4 is an end view of one leg of the saddle mount and the wedge shaped end of a journal assembled with the mount to support the cutter on the mount.

The cutter 23 is mounted on a journal that contains bearings (not shown) that mate with opposed bearings (not shown) inside the cutter to reduce friction. Commonly, there is a lubrication system that cooperates with the metal components of the bearing to assure the lowest possible coefficient of friction and the longest possible bearing life. Each of the two ends 29, 31 of the journal is configured to match the shape of the associated leg 33, 35 of the saddle mount 25 (see FIG. 3). And each end is wedge shaped in the manner of end 29, as shown in FIG. 4.

The adjacent sides 37, 39 of the wedge shaped end 29 have an included angle that is acute and selected from the range of about thirty to sixty degrees. The angle of the illustrated wedge is about 35 degrees, which provides adequate holding force while avoiding the creation of a "taper lock" that would make disassembly difficult. The outer end of opposite leg 35 and mating wedge shaped end 31 of the journal have a fastener and hole arrangement identical to that indicated in leg 33.

The mating surfaces 41, 43 of the leg 33 (see FIG. 4) form a wedge shaped opening that mates with the adjacent sides 37, 39 of wedge shaped end 29, which is polygon with inner and outer ends 45, 47 that are normal to a bolt hole 49 that registers with a coaxial bolt hole 51 in the leg 33. A bolt head 53 resides in a counterbore 55 and the bolt 57 is threaded on one end to receive a nut 59 in a counterbore 61. When the nut 59 is tightened, the wedge shaped end 29 is pulled toward the nut, and the adjacent sides 37, 39 are forcefully urged toward the mating surfaces 41, 43 of the leg 33. Outer surface 41 of the leg and the mating outer surface 37 (i.e., surface located toward the cutting extremity of the cutter 23) of the wedge shaped end 29 of the journal are at the above stated acute angle with the normally horizontal surface 43 of the leg and the mating surface 39 of the wedge. The horizontal surface 43 makes alignment easier during assembly and the acute surface 41 provides forceful retention of the wedge shaped end 29. This configuration tends to lessen the loads imposed on the bolt during drilling, contributing to reliability in addition to ease of assembly and disassembly.

While we have shown our invention in only one of its forms, it should be apparent to those of ordinary skill in the art that it is not thus limited, but is susceptible to various changes and modifications without departing from the spirit thereof.

We claim:

1. A mounting system to secure raise or shaft cutters to a bit body, comprising:

a mount adapted for connection to the bit body and having at least one leg that extends at an acute angle to the rotational axis of the bit body;

a journal having one wedge shape end adapted to be secured to a wedge shape opening in the leg;

an earth disintegrating cutter rotatably secured to the journal;

the wedge on the journal having a fastener hole to register coaxially with a fastener hole in the leg and being adapted to receive a fastener to secure the wedge on the journal in the wedge shape in the leg;

one side of the wedge shape being generally perpendicular to the rotational axis of the bit body, the adjacent side forming an acute angle with the perpendicular side.

2. The invention defined by claim 1 wherein said acute angle is in a range of about thirty to sixty degrees.

3. The invention defined by claim 2 wherein said acute angle has an angle of about 35 degrees.

4. A mounting system to secure raise or shaft cutters to a bit body, comprising:

a mount adapted for connection to the bit body and having a pair of legs that extend along the rotational axis of the bit body;

a journal having opposite ends adapted to be secured to an opening in one of the legs;

an earth disintegrating cutter rotatably secured to the journal;

a wedge on one end of the journal, with a fastener hole to register coaxially with a fastener hole in one of the legs;

said opening in the leg having a wedge shape to mate with the wedge on the journal;

a fastener in the registering fastener holes to secure the wedge on the journal in the wedge shape in the leg;

one side of the wedge shape being generally perpendicular to the rotational axis of the bit body, the adjacent side forming an acute angle with the perpendicular side.

5. The invention defined by claim 4 wherein said acute angle is in a range of about thirty to sixty degrees.

6. The invention defined by claim 5 wherein said acute angle has an angle of about 35 degrees.

7. A mounting system to secure raise or shaft cutters to a bit body, comprising:

a mount adapted for connection to the bit body and having a pair of legs that extend at an acute angle to the rotational axis of the bit body;

a journal having opposite ends, each adapted to be secured to an opening in one of the legs;

an earth disintegrating cutter rotatably secured to the journal;

a wedge on one each end of the journal, with a fastener hole in each end to register coaxially with a fastener hole in an associated leg;

said opening in each leg having a wedge shape to mate with a wedge on the journal;

a fastener in each pair of the registering fastener holes to secure the wedges on the journal in the wedge shapes in the legs;

one side of each wedge shape having an inner surface, generally perpendicular to the rotational axis of the bit body and another side defining an outward surface located toward the cutting extremity of the cutter, the inner and outer surfaces of the wedge forming an acute angle.

8. The invention defined by claim 7 wherein said acute angle is in a range of about thirty to sixty degrees.

9. The invention defined by claim 8 wherein said acute angle has an angle of about 35 degrees.

* * * * *